United States Patent [19]

Diederich

[11] Patent Number: 5,018,963

[45] Date of Patent: May 28, 1991

[54] PULSATING GAS POWERED LIGHT SOURCE

[75] Inventor: Walter J. Diederich, West Newbury, Mass.

[73] Assignee: TPV Energy System, Inc., Waltham, Mass.

[21] Appl. No.: 390,641

[22] Filed: Aug. 7, 1989

[51] Int. Cl.[5] ..... F23C 11/00

[52] U.S. Cl. ..... 431/1; 431/110; 431/12; 362/179; 137/624.14

[58] Field of Search ..... 431/1, 110, 100, 111, 431/12; 362/159, 179; 239/99; 222/649, 644, 645; 137/624.14; 60/39.81, 39.8; 236/81

[56] References Cited

U.S. PATENT DOCUMENTS

| | | | |
|---|---|---|---|
| 221,758 | 11/1879 | Westphal | 139/505.25 |
| 854,880 | 5/1907 | Ehemann | 137/624.14 |
| 906,285 | 12/1908 | Von Post | 137/624.14 |
| 921,272 | 5/1909 | McCarthy | 137/505.25 |
| 923,474 | 6/1909 | Willson . | |
| 1,015,532 | 1/1912 | Attwood | 137/624.14 |
| 1,069,702 | 8/1913 | Jackson | 137/624.14 |
| 1,079,272 | 11/1913 | Snedden | 431/89 |
| 1,309,482 | 7/1919 | Leonardi | 431/89 X |
| 1,320,209 | 10/1919 | Dalen | 431/1 |
| 1,528,485 | 3/1925 | Hulse | 137/624.14 |
| 1,673,834 | 6/1928 | Lindahl | 137/624.14 |
| 1,912,351 | 5/1933 | Atkins et al. . | |
| 2,135,826 | 11/1938 | Marischal . | |
| 2,963,891 | 12/1960 | Brueninghaus . | |
| 3,004,712 | 10/1961 | Noakes | 236/81 X |
| 3,039,699 | 6/1962 | Allen | 431/1 X |
| 3,078,365 | 2/1963 | Atkins et al. | 431/1 X |
| 3,096,027 | 7/1963 | Atkins et al. . | |
| 3,114,251 | 12/1963 | Atkins et al. . | |
| 3,176,709 | 4/1965 | Jones . | |
| 3,190,314 | 6/1965 | Visos | 422/160 |
| 3,210,966 | 10/1965 | Kilbourn . | |
| 3,443,583 | 5/1969 | Webb . | |
| 3,477,613 | 11/1969 | Mangel | 137/624.14 X |
| 4,025,280 | 5/1977 | Wilson . | |
| 4,077,542 | 3/1978 | Petterson | 222/649 |
| 4,240,458 | 12/1980 | Huff . | |
| 4,475,882 | 10/1984 | Gruner . | |
| 4,496,308 | 1/1985 | Gruner . | |
| 4,497,339 | 2/1985 | Gruner et al. . | |

FOREIGN PATENT DOCUMENTS

| | | | |
|---|---|---|---|
| EP83108018.9 | 8/1983 | Fed. Rep. of Germany . | |
| 2171193 | 2/1973 | France . | |
| 223646 | 9/1942 | Switzerland | 137/505.25 |
| 233027 | 9/1908 | Fed. Rep. of Germany . | |
| 83108018 | 8/1983 | Fed. Rep. of Germany . | |
| 223646 | 9/1942 | Switzerland | 505.25/ |

*Primary Examiner*—Carl D. Price
*Attorney, Agent, or Firm*—Fish & Richardson

[57] ABSTRACT

The present invention relates to a pulsating gas fuel light source, utilizing a flexible diaphragm secured within a housing that reciprocates between two positions to generate a pulsating fuel flow thereby providing a lamp which flashes at regular intervals. The pulsating gas fuel light source is suitable for use as a highly visible warning light for construction sites on highways to warn passing traffic.

36 Claims, 8 Drawing Sheets

PULSATING GAS POWERED LIGHT SOURCE

BACKGROUND OF THE INVENTION

The present invention relates to pressure regulating systems generally, and in particular, to gas fuel flow regulators for warning lights which alternate between high and low intensity.

Reliable, weather resistant signal lights which are inexpensive to operate and require minimal routine service have numerous uses. Such lights are primarily in demand as warnings to the public near construction sites such as highway projects. Warning lights that also periodically flash or pulse are often required for these applications to maximize notice to oncoming traffic of potential hazards.

Flashing lights have been restricted to battery powered devices which, though highly conspicuous, are limited by the performance of the batteries. Among the many problems posed by battery powered sources are the high cost of battery replacement, the low energy storage capacity of batteries, the need for frequent battery service, substantial decay of light output with battery aging, poor performance of batteries at low temperature, and problems associated with battery disposal.

Hydrocarbon fuels such as propane, butane, and isobutane eliminate problems of high cost, frequency of replacement and disposal of the power source. However, continuous flashing of light between high and low intensity through regular fluctuation of fuel delivery over wide ranges of temperature typically encountered for such applications has been difficult to attain. Others who have attempted use of hydrocarbon fuel for warning lights have concentrated on providing a continuous flow of fuel to a burner which is then combusted in an irregular fashion to create a flickering effect. These devices are often further limited in that the flickering effect is altered by various surrounding elements such as turbulence due to proximate air currents. Other systems have used valves to control flow to a flame by triggering the valve to open when the difference in pressure across the valve exceeds a pre-selected level.

Thus, a need exists for an inexpensive yet dependable gas regulator assembly for a warning light that can be used under variable weather conditions and provides a safe and highly visible warning to the public of potential hazards.

SUMMARY OF THE INVENTION

The present invention relates to an apparatus and method for delivering a pulsating fuel flow to a mantle for combustion. A flexible diaphragm is secured within a housing and is moveable between a first position and a second position to provide a pulsed light source. The housing supports a lamp to which fuel is delivered for combustion. The flexible diaphragm moves between the first and second positions in response to variations in pressure of a combustible gas within the housing. The diaphragm is constructed such as to be under reduced stress in the first and second positions. In a preferred embodiment, the diaphragm can be prestressed to assure that the first and second positions correspond to concave to convex configurations of the diaphragm. A regulator valve opens in response to the movement of the diaphragm into the first position resulting in the delivery of fuel at an increased rate to the lamp. When the diaphragm is in the second position the regulator valve closes resulting in the reduction in the rate of fuel delivery to the lamp.

A method for generating a pulsating gas fuel light involves flowing the fuel through a channel or conduit in a stem from the diaphragm chamber and delivering the fuel to a mantle for combustion. The diaphragm partially encloses a chamber that receives fuel through the regulator valve when the diaphragm is in the first position. Pulsation of flow delivered from a fuel source is achieved by having the chamber pressure exceed a threshold pressure at which the diaphragm flips to the second position thereby closing the regulator valve and terminating flow of the gas to the chamber from the fuel source. Pressure of the gas within the chamber then drops to below a predetermined level, causing the diaphragm to flip back to its first position, thereby opening the regulator valve and causing fuel to flow from the source into the chamber.

Due to the reciprocating motion of the diaphragm, the rate at which fuel flows through the orifice oscillates between minimum and maximum levels. When the diaphragm valve is open, pressure develops within the chamber causing the regulator valve to close. The flow rate from the chamber to the mantle rapidly increases to create a greatly accelerated rate of combustion at the mantle generating a flame in the mantle that produces a light approximately twenty times brighter than the light which emanates during combustion when the fuel flow rate from the chamber is at a minimum. The mantle thus emanates light at a relatively great intensity until pressure within the chamber diminishes. Combustion subsequently slows to a minimal rate in which very little light emanates from the mantle.

The pulsating light source of the present invention provides a regular periodic supply of propane delivered from a fuel reservoir to an ignited mantle suitable for use as a pulsating light in adverse conditions such as construction sites for highway maintenance where the flame does not extinguish during operation.

The gaseous fuel is delivered under pressure from a fuel reservoir to the pulsating light source through a check valve assembly and regulator valve assembly. The check valve operates to prevent liquid fuel from reaching the diaphragm.

Fuel from the pulsating fuel delivery system of the present invention may be combusted by a Welsbach mantle that is suitable for road-hazard light applications; however, other means of combustion can be used. The fuel delivery system of the present invention can also be used for different applications in which a pulsating gas flow is desirable. These alternative embodiments include a variety of industrial and consumer applications.

The above features and other details of the invention, either as steps of the method or as combinations of parts of the invention, will now be more particularly described with reference to the accompanying drawings and pointed out in the claims. It will be understood that the particular embodiments of the invention are shown by way of illustration only and not as a limitation of the invention. The principal features of this invention may be employed in various embodiments without departing from the scope of the invention.

DETAILED DESCRIPTION OF THE INVENTION

Figure 1:
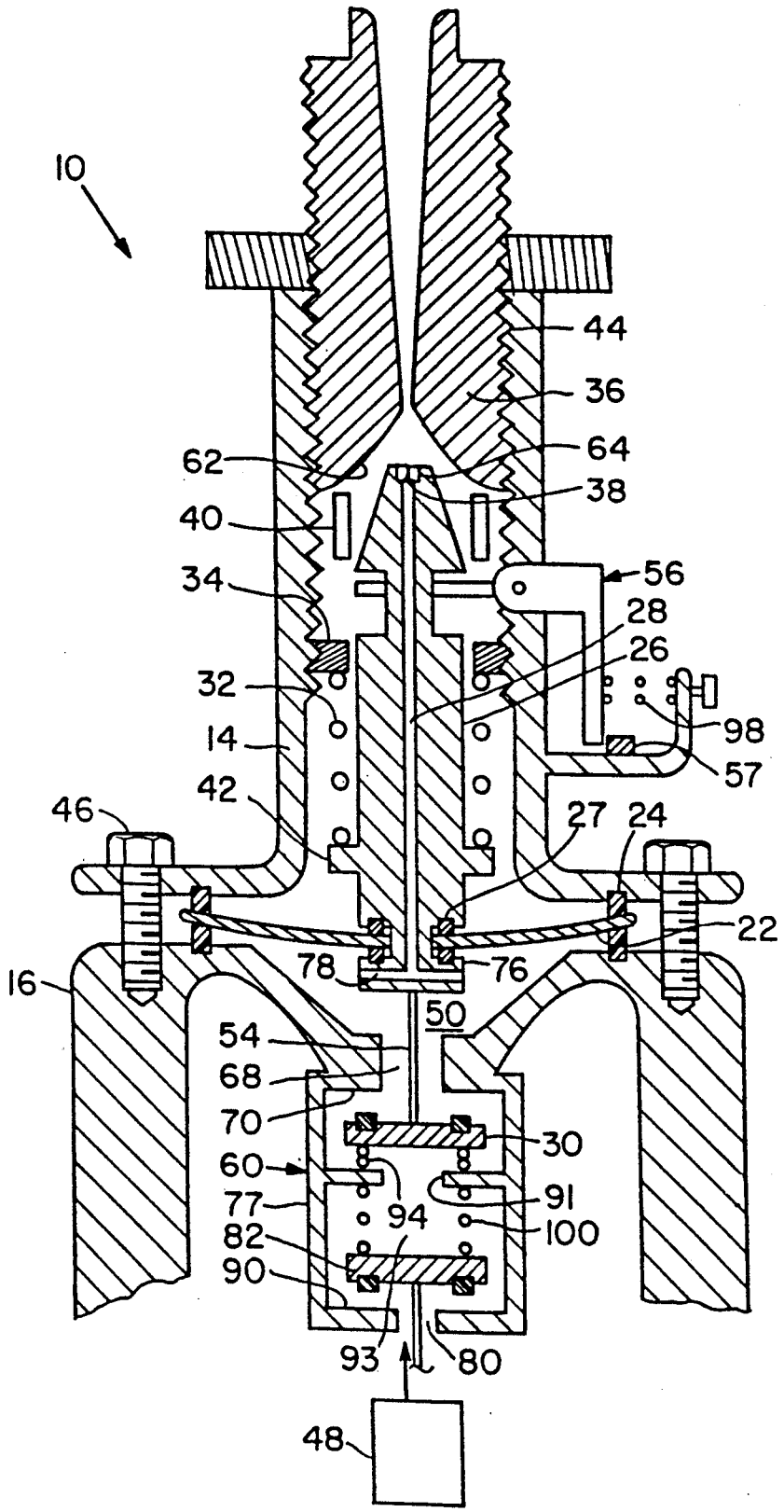
FIG. 1 is a cross-sectional view of a pulsating gas fuel source of the present invention with a mechanical switch for the fuel source in the "flash" position.
Figure 2:
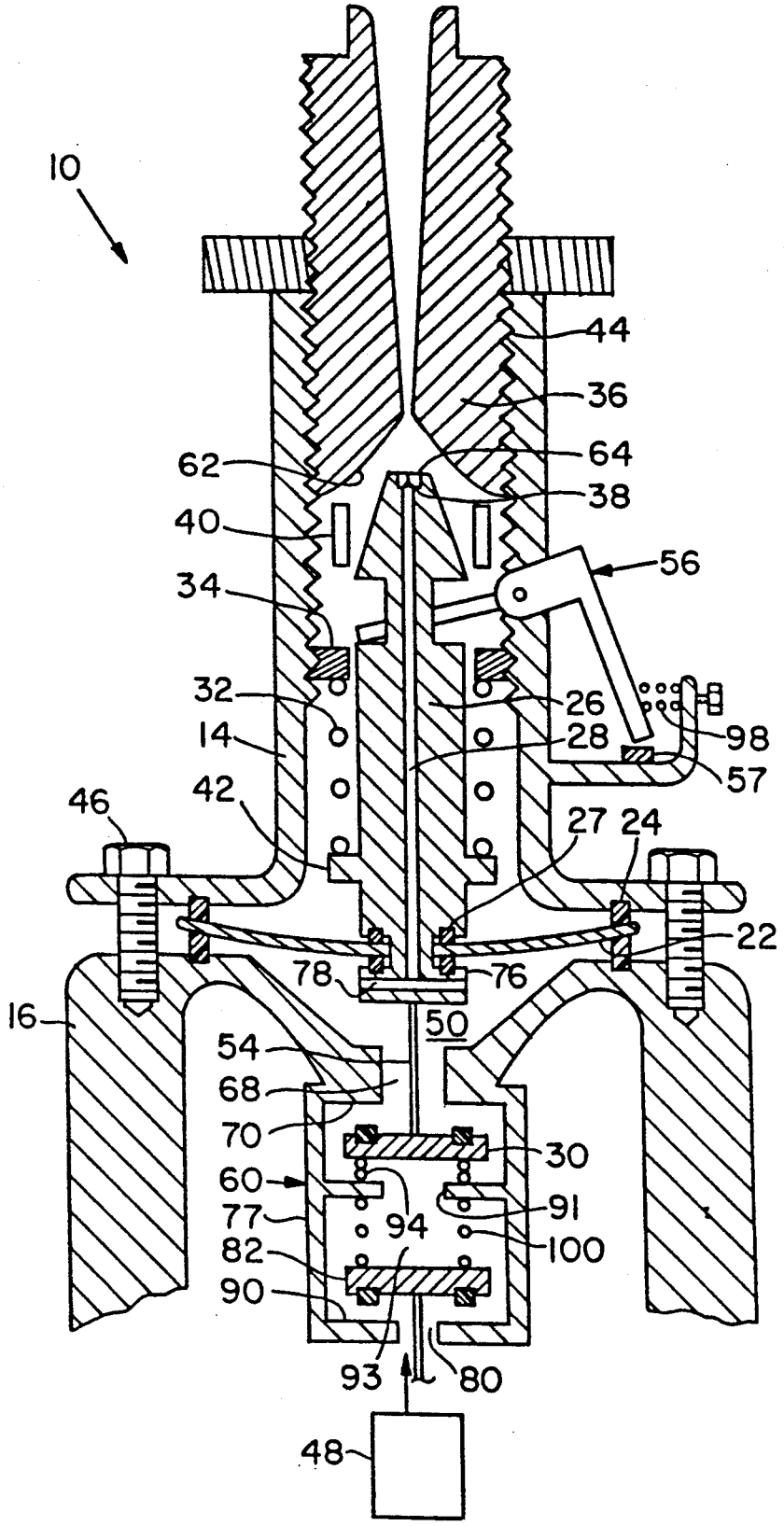
FIG. 2 is a cross-sectional view of the pulsating gas fuel source of FIG. 1 with the mechanical switch in the "on" position.
Figure 3:
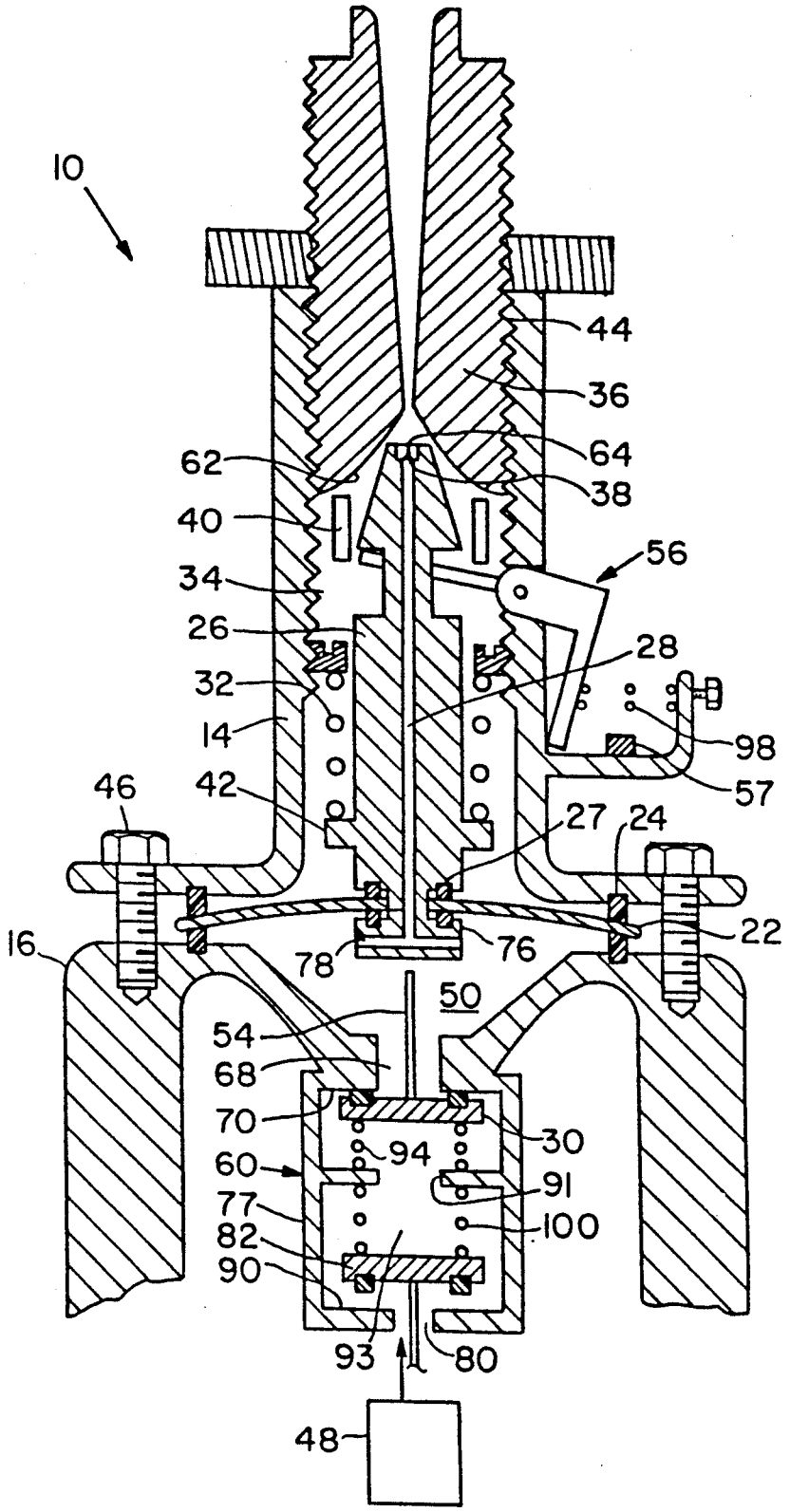
FIG. 3 is a cross-sectional view of the pulsating gas fuel source with a regulator valve in the closed position and the mechanical switch in the "off" position.

Cross sectional views of a preferred embodiment of a pulsating gas fuel supply system 10 are shown in FIGS. 1 through 3. A flexible diaphragm 22, whose characteristics and operation are of central importance to the present invention, is supported between a lower mount 16 and upper mount 14. Gaskets 24 secure diaphragm 22 between upper and lower mounts 14, 16 and can be composed of neoprene, Buna-N or some other appropriate sealing material. Stem 26 that moves in conjunction with the diaphragm 22 is secured near one end to the diaphragm by stem gaskets 27. Conduit 28 that extends through stem 26 terminates at exit aperture 38.

Figure 6:
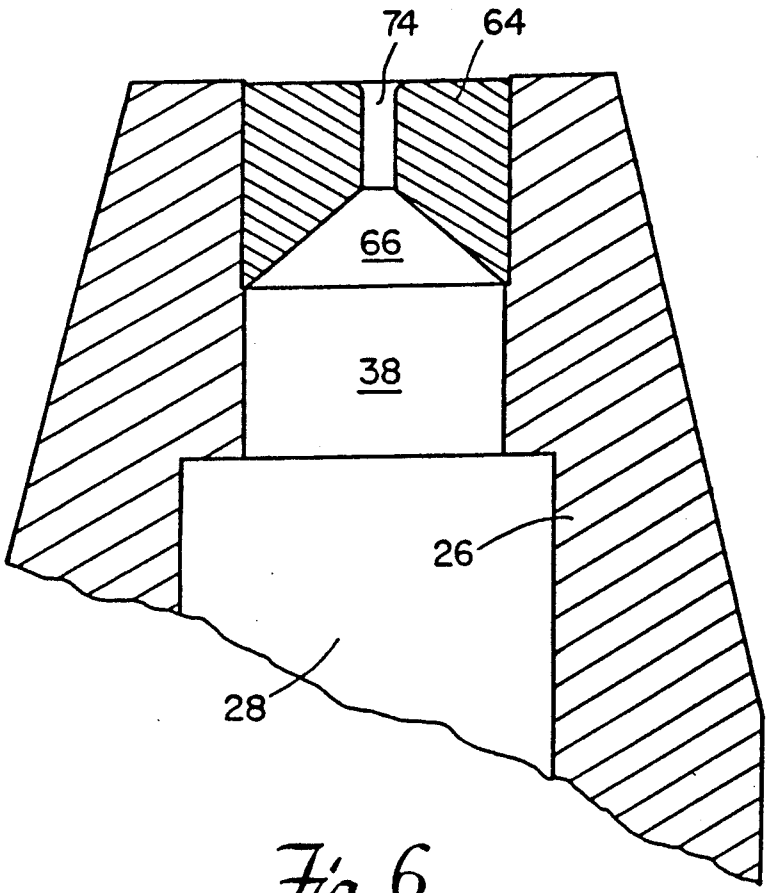
FIG. 6 is a cross-sectional view of the stem orifice of the present invention.

The material forming the stem orifice positioned within aperture 38 is a hard crystal 64, preferably made of sapphire. As shown in FIG. 6, the crystal 64 has a bore 74 therethrough of approximately 25 to 50 microns in diameter in this embodiment. Entrance 66 of stem orifice 64 is chamfered, and the stem orifice is set in place by an interference press-fit within exit 38.

Returning to FIG. 1, the stem 26 has a T-shaped bore 78 providing fluid communication between a chamber 50, whose shape is defined by lower mount 16 and diaphragm 22, and conduit 28 which directs fluid to the orifice 64.

A biasing spring 32 is positioned between an annular ring 42 of stem 26 and adjustment nut 34. The biasing spring 32 urges the diaphragm 22 to one of its two possible positions as described below.

A venturi 36 is disposed within upper mount 14 and directly above stem 26 that directs the gas to the mantle. Air inlet ports 40 provide fluid communication between surrounding air and the gas exiting the stem 26. Venturi 36 and adjustment nut 34 are threadably engaged with upper mount 14.

Diaphragm 22 can be constructed and mounted such that it is stable in either or both of two shapes: a "first" position shown in FIG. 1, which is convex relative to chamber 50, and a "second" position which is concave relative to chamber 50, shown in FIG. 3. The diaphragm can be formed having such an intrinsic compressive stress such that it preferably assumes either the first or the second position. In either case, diaphragm 22 thereby demonstrates hysteresis whereby the level of stress in the diaphragm is lower in the first and second positions relative to its stress during movement between the two positions. In a preferred embodiment the diaphragm 22 typically approximates 2 centimeters in diameter, is between 100 microns to 300 microns thick, and is preferably composed of stainless steel (alloy 17-7 PH or 18-8), phosphor-bronze (fine grained), blue-tempered steel or of a polymeric material, although other materials can be used. Upper mount 14 and lower mount 16 are contoured so that diaphragm 22 can move freely between the first and second positions. Upper mount 14 is secured to lower mount 16 by bolts 46 or by some other conventional fastener. Alternatively, upper mount 14 and lower mount 16 can be sealed or molded to form an integral housing.

Mechanical switch 56 is secured to upper mount 14 and may be manually moved to an "on," "off," or "flash" position. When switch 56 is in the "on" position, as shown in FIG. 2, diaphragm 22 is held in a first position by switch 56 and regulator valve 30 is open. Spring 98 provides a biasing force at a preselected pressure that works in conjunction with diaphragm 22 to regulate the gas pressure in chamber 50. In the "off" position, shown in FIG. 3, switch 56 holds diaphragm 22 in a second position in which regulator valve 30 is closed. When the switch 56 is in the "flash" position, shown in FIG. 1, diaphragm 22 is freed for periodic movement between the first and second positions. In the "flash" position, switch 58 abuts bumper 57. Spring 98 is under tension when switch 56 is in the "off", "on" and "flash" positions. Switch 56 may also be adapted to close regulator valve 30 automatically upon an attempt to access the reservoir 48 for refilling with fuel.

Figure 5:
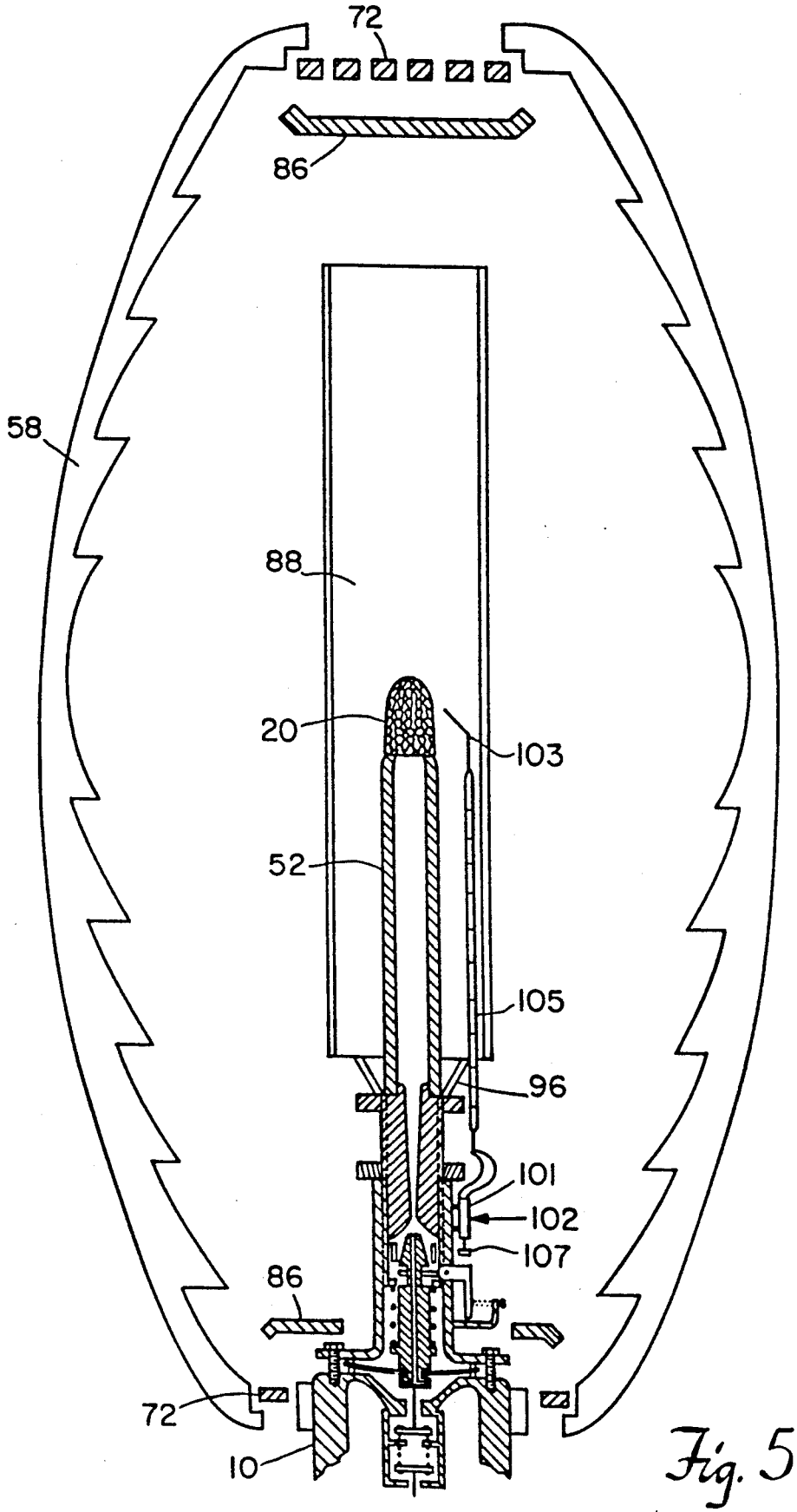
FIG. 5 is a cross-sectional view of the mantle and lens of the present invention.

Piezoelectric igniter 102, shown in FIG. 5, is used to initiate combustion in the mantle to establish continuous lighting or to begin periodic flashing. Metallic electrodes 103 (only one shown) are supported by ceramic sleeve 105 proximate to mantle 20 and ignites the fuel by an electrical spark, generated when the piezoelectric element 101 is impacted by trigger 107. Note that any other suitable ignition system can be employed.

As shown in FIG. 5, tube 52 is supported by venturi 36 and is preferably composed of ceramic. Tube 52 and upper mount 14 also support a mantle 20. A lens 58 that is placed over mantle 20 for greater visibility and to adapt the appearance of and to collimate light emanating from mantle 20 for particular applications. The preferred type of lens 58 is a "Fresnel" lens. A metallic shield having perforations is fitted on lens 58 as a flame arrestor 72. Heat sink 86, composed of a suitable metal or some other heat conducting material, is secured within lens 58 for dissipating heat generated by combustion at mantle 20 and for protecting the system from adverse weather conditions. Cylinder 88 is composed of glass or some other transparent material. Supports 96 fix cylinder 88 about mantle 20 for conduction by the cylinder of heat away from lens 58 if the light source 10 is oriented in a substantially horizontal position.

Figure 4:
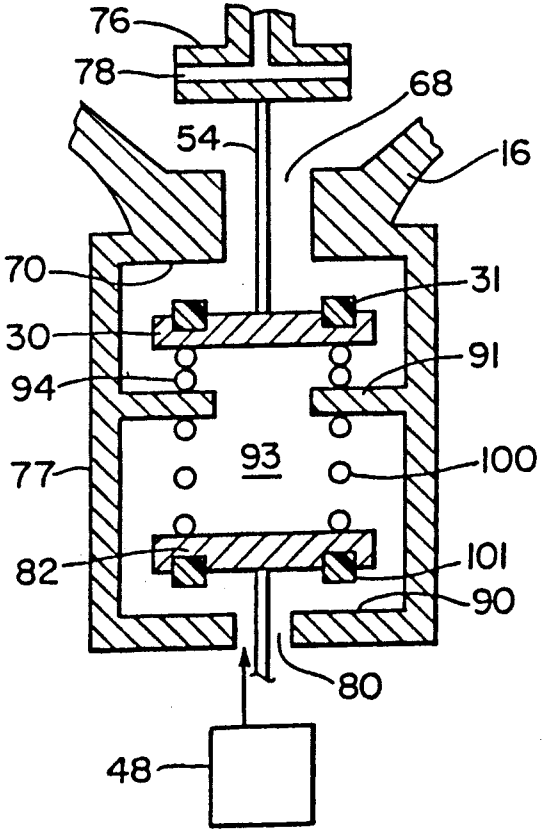
FIG. 4 is a cross-sectional view of the check valve assembly of the present invention.

In a preferred embodiment, a check valve 82 is disposed between reservoir 48 and regulator valve 30 for preventing the flow of liquid fuel from reservoir 48 to mantle 20. As seen in FIG. 4, regulator valve 30 is partially enclosed within regulator valve housing 77 of the regulator valve assembly 60. When check valve 82 is seated on check valve seat 90, reservoir 48 is sealed from regulator valve 30. Check valve 82 and check valve spring 100 are dimensioned and configured to provide fluid communication between reservoir 48 and regulator valve 30 when the pressure drop across check valve 82 is approximately equal to or greater than about $1\times10^5$ Nt/m$^2$ or any other selected pressure. Check valve spring 100 extends between annular rim 91 and check valve 82 and directs check valve 82 onto check valve seat 90 when the pressure drop across fuel valve 82 is less than the selected pressure difference, which in this embodiment, is about $1\times10^5$ Nt/m$^2$. Check valve 82 and check valve spring 100 thereby prevent uncontrolled combustion and other consequences by barring flow of liquid fuel through regulator valve chamber 93 to chamber 50.

When diaphragm 22 is in the first position shown in FIG. 1, regulator valve chamber 93 is in fluid communication with diaphragm 22 and delivers gaseous fuel from chamber 93 to chamber 50. The fuel is preferably propane, but butane, isobutane or other types of hydrocarbon fuels can be used. Mantle 20 is ignited by piezoelectric element 102, shown in FIG. 5, although other conventional ignition means can also be used. Once the mantle is ignited, light is emitted therefrom, and the light is referred to as being in an ignited condition.

While regulator valve 30 is in the open position fuel passes through aperture 68 into chamber 50. Pressure abruptly increases in chamber 50 to a preselected level and displaces diaphragm 22 from the stable first position to a stable second position shown in FIG. 3. Displacement of diaphragm 22 to the second position is attained when accumulated pressure within chamber 50 applies a force to the diaphragm sufficient to overcome the sum of the force of biasing element or spring 32 and intrinsic forces, such as resistance to deformation which maintain the diaphragm 22 in the first position. Intrinsic compressive stress or the preformed shape of diaphragm 22 contributes to the stability of the diaphragm in the first position which must be overcome by the pressure of gas accumulating in chamber 50. Gaseous pressure within chamber 50 displaces diaphragm 22 from the first position to a second position shown in FIG. 3, in opposition to the above mentioned forces maintaining diaphragm 22 in the first position. Pressure within chamber 50 preferably varies between approximately 14 and 40 Nt/m$^2$ during the flash cycle.

Movement of the diaphragm 22 to the second position allows regulator valve 30 to be directed onto regulator valve seat 70 by regulator spring 94, which extends between regulator valve 30 and annular rim 91, thereby closing aperture 68 and terminating the flow of fuel from the regulator valve chamber 93 to diaphragm 22. The diaphragm can be said to reciprocate between two relatively low energy states in comparison to the diaphragm energy when in transition between these states. In the illustrated embodiments, the movement of stem 26 can be directed against valve 30 by a pin 54.

Fuel subsequently passes out of chamber 50 through conduit 28 and bore 74, as shown in FIG. 6, and mixes with air drawn through air inlet ports 40 and reverse taper 62 by entrainment, through venturi 36 and tube 52, and then passes to mantle 20 where the air/gas mixture is combusted. Air is also drawn to mantle 20 from surrounding air for combustion at the mantle. Immediately following displacement of diaphragm 22 to the second position, fuel passes from chamber 50 to mantle 20 at the highest rate to obtain a peak illumination of the mantle which is highly visible. During peak illumination, the luminosity of mantle 20 is approximately 20 times more brilliant than during periods when the mantle is in a minimum brightness condition. The brightness of the ignited mantle can be changed by adjusting the position of venturi 36 along threads 44 of upper mount 14.

While diaphragm 22 is in the second position, the pressure of the fuel within chamber 50 supports diaphragm 22 in the second position. When the pressure of the gas within chamber 50 drops below a threshold pressure, the diaphragm 22 will flip to the first position.

Fuel in chamber 50 dissipates through conduit 28, while the diaphragm is in the second position, and the rate of combustion diminishes until the flame at mantle 20 is barely visible, the light then being in a minimum brightness condition. Fuel in chamber 50 subsequently mixes with air entrained through air inlet ports 40, venturi 36 and tube 52 and burns at mantle 20 for providing perpetual combustion during periodic flashing of the mantle 20. Dissipation of fuel vapor while diaphragm 22 is in the second position continues until vapor pressure in chamber 50 diminishes to a pre-selected minimum pressure. The diaphragm 22 subsequently flips when biasing spring 32 urges diaphragm 22 from the second position back to the first position, and overcomes the diminishing force of vapor pressure in the chamber and any compressive stress or resistance to deformation within the diaphragm holding the diaphragm in the second position. The biasing force of biasing spring 32 can be adjusted by rotating adjustment nut 34 along threadable engagement with threads 44 of upper mount 14.

Displacement of diaphragm 22 from the second position to the first position unseats regulator valve 30 by movement of pin 54 and re-establishes fluid communication between regulator valve chamber 93 and chamber 50. Delivery of fuel at a rapid rate from chamber 50 is thereby re-established, switching the light from the minimum brightness condition to the peak illumination condition. The cycle between maximum and minimum illuminations of the light is repeated, creating a regular, highly visible flash. The rate of flashing can be adjusted by varying the force of biasing spring 32, the dimensions or strength of materials of the diaphragm 22, the rate of fuel flow to the diaphragm 22, the size of orifice 74, the volume of chamber 50 or by any combination of the above or other factors. Frequency of flashes will typically approximate 65 flashes per minute, with peak illumination occupying at least 10% of the cycle period, thereby being suitable as a warning light in a wide variety of weather conditions.

Figure 8:
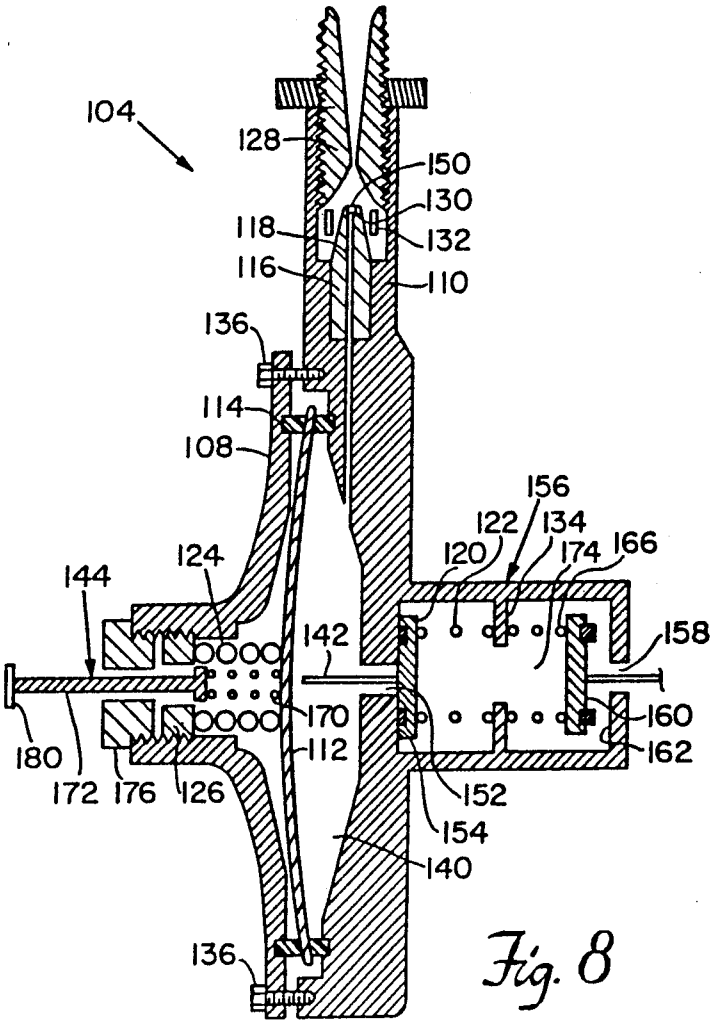
FIG. 8 is a cross-sectional view of the embodiment of FIG. 7 with the valve in the closed position.
Figure 7:
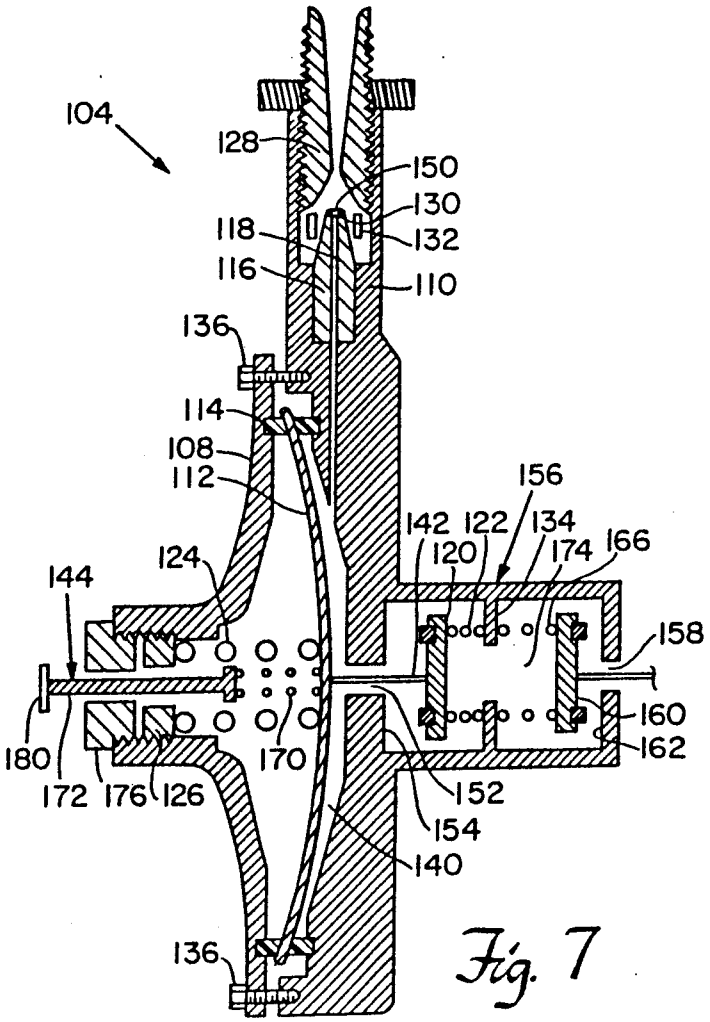
FIG. 7 is a cross-sectional view of another preferred embodiment of the present invention in the open position.

In another preferred embodiment of the invention, shown in FIGS. 7 and 8, the pulsating gas fuel supply system 104 supports diaphragm 112 between switch mount 108 and stem mount 110. Switch mount 108 and stem mount 110 are secured by bolts 136 or by some other conventional fastener. As with the previously described embodiment, there are diaphragm gaskets 114 which seal flexible diaphragm 112 within mounts 108 and 110. The stem 116 is stationary in this embodiment and is secured within stem mount 110 and a conduit 118 extends through stem 116 and terminates at exit aperture 130. The stem orifice 150 is set in place by an interference press fit within exit aperture 130. A biasing spring 124 extends between adjustment nut 126 and flexible diaphragm 112 and operates to urge the diaphragm between positions. A venturi 128 is disposed within stem mount 110 to control the flow of fuel and the air received through the air inlet ports 132 which provide fluid communication between surrounding air and stem orifice 150. Diaphragm 112 can be stable in either or both of two positions: a "first" position shown in FIG. 7 and a "second" position shown in FIG. 8. The diaphragm 112 moves from the first position to the second position abruptly upon passage of fuel through regulator valve 120.

The diaphragm can be formed such that intrinsic compressive stress causes the diaphragm to assume either the first or the second position in which it has reduced energy or stress relative to any of its intermediate positions. Diaphragm 112 demonstrates the same physical properties as that of diaphragm 22 in the first embodiment described above.

Mechanical switch 144 is secured to switch mount 108 and may be manually moved to an "on"or a "flash" position. When mechanical switch 144 is in the "on" position, as shown in FIG. 7, diaphragm 112 is held in a first position by force of mechanical switch rod 172 which compresses mechanical switch spring 170 and thereby directs flexible diaphragm 112 and connecting member 142 against regulator valve 120. In the first position of diaphragm 112, shown in FIG. 7, chamber 140 is in fluid communication with valve chamber 174. Collar 176 supports mechanical switch rod 172.

A mantle, ceramic tube and lens can be mounted at venturi 128, as mantle 20, tube 52 and lens 58 do at venturi 36 in FIG. 5 as described above regarding the first embodiment.

Regulator valve assembly 156 operates in the same manner as regulator valve assembly 60 described in the first embodiment. Regulator spring 122 is compressed by movement of diaphragm 112 from the second position back to the first position. When check valve 160 is open, check valve spring 166 is compressed and fuel from a reservoir passes through a fuel entrance 158 into valve chamber 174. If pressure drop across check valve 160 diminishes to below a preselected minimum, the check valve will seat on check valve seat 162 and terminate flow of fuel into valve chamber 174.

Figure 10:
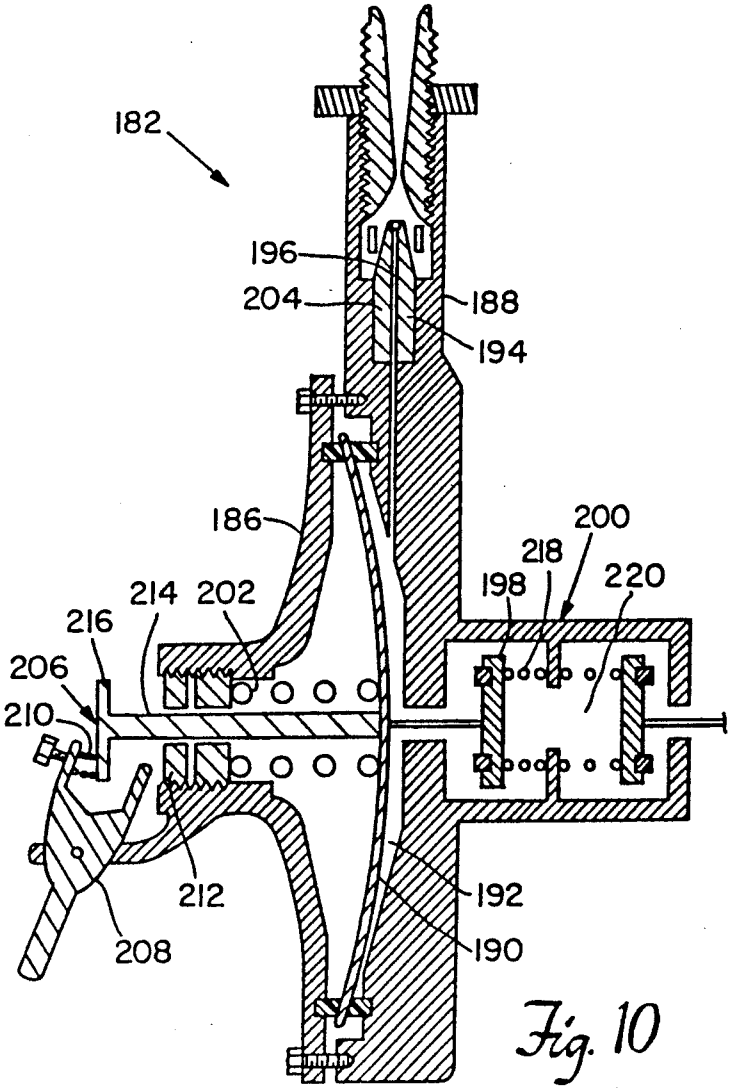
FIG. 10 is a cross-sectional view of the embodiment of FIG. 9 with the valve in the open position and the mechanical switch in the "on" position.
Figure 9:
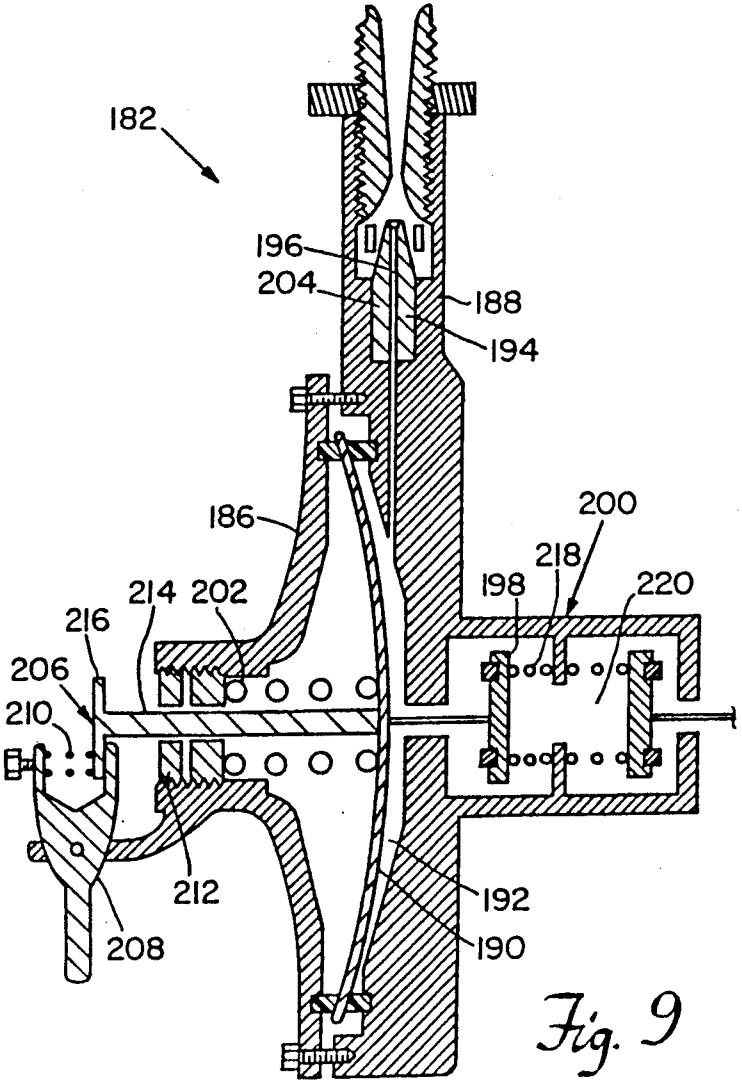
FIG. 9 is a cross-sectional view of a further preferred embodiment of the present invention with the valve in the open position and a mechanical switch in the "flash" position.
Figure 11:
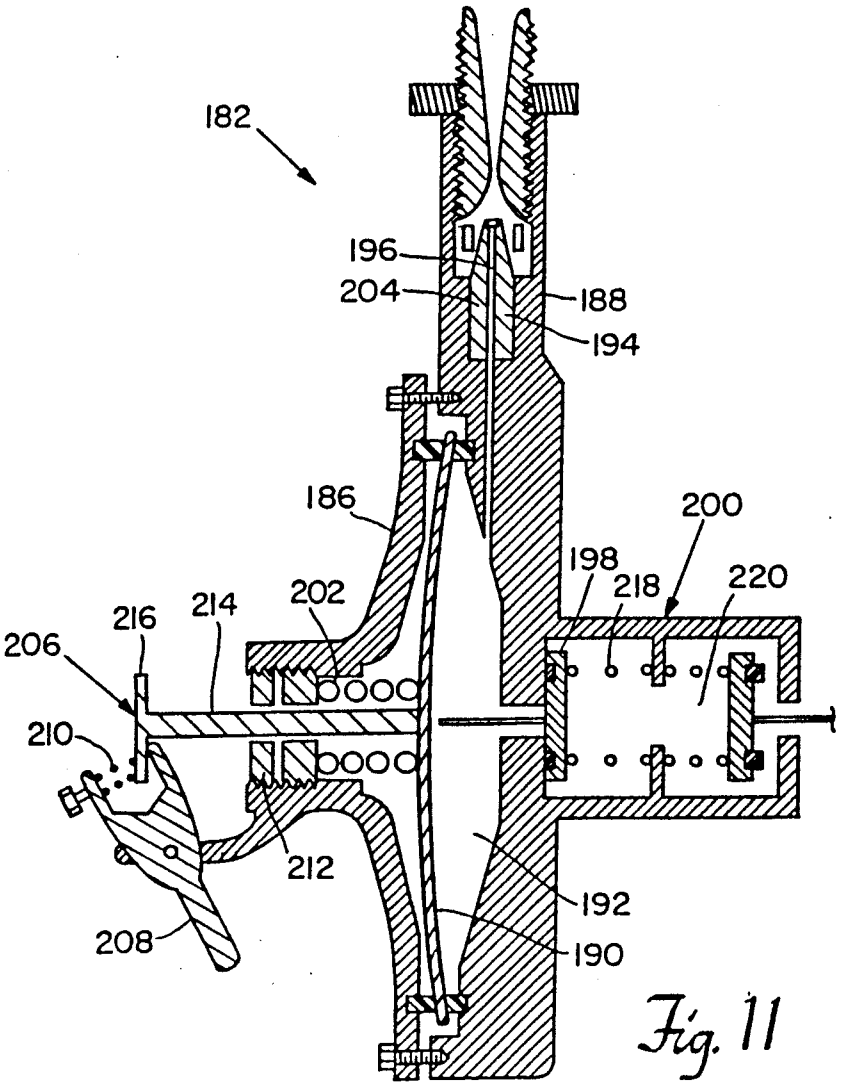
FIG. 11 is a cross-sectional view of the embodiment of FIGS. 9 and 10 with the valve in the closed position and the mechanical switch in the "off" position.

In another embodiment, shown in FIGS. 9, 10, and 11, diaphragm 190 is supported between switch mount 186 and stem mount 188. Stem 194 is fixed to stem mount 188 and rod 214 is fixed to diaphragm 190. Mechanical switch assembly 206 may be manually moved to a "on", "off"or "flash" position. Mechanical switch rod 214 is supported by collar 212 and is actuated by mechanical switch lever 208. Cap 216 and rod 214 are movable between a first position of diaphragm 190, shown in FIG. 9, and a second position of diaphragm 190, shown in FIG. 11. When diaphragm 190 is in the first position, regulator valve 198 is unseated and regulator spring 218 is compressed for providing fluid communication between valve chamber 220 and diaphragm 190. When mechanical switch assembly 206 is in the "on" position, shown in FIG. 10, mechanical rod 214 forces diaphragm 190 into the first position. Spring 210 is disposed between switch lever 208 and cap 216 to allow movement of diaphragm 190 for pressure regulation. In the "off" position, shown in FIG. 11, switch lever 208 locks diaphragm 190 in the second position by supporting rod 214 and holding biasing spring 202 in a compressed position. Regulator valve 198 is thus seated and prevents flowing of fuel to chamber 192. Regulator valve assembly 200 operates as described with reference to the embodiments of FIGS. 1 and 2.

A mantle, tube and lens are mounted at venturi 204, in a manner similar to mantle 20, tube 52 and lens 58 at venturi 36 in FIG. 5 as described above.

What is claimed:

1. A pulsating gas fuel light source comprising:

a housing supporting a lamp to which a fuel is continuously delivered for combustion;

a flexible diaphragm secured within the housing and formed to reciprocate between a first position and a second position in response to variations in pressure of a gas within the housing such that the diaphragm has reduced stress in the first and second positions relative to the diaphragm stress between the first and second positions; and a regulator valve that is opened by movement of the diaphragm into the first position resulting in the delivery of fuel at an increased rate to the lamp and such that when the diaphragm is in the second position the valve closes resulting in the reduction of the rate of fuel delivery to the lamp.

2. The light source of claim 1 wherein the lamp comprises a mantle.

3. The light source of claim 1 wherein the diaphragm has an intrinsic compressive stress.

4. The light source of claim 1 further comprising a stem having a conduit providing fluid communication between a fuel source and the lamp.

5. The light source of claim 4 wherein movement of the diaphragm actuates movement of a pin secured to the valve wherein the pin is separable from the diaphragm.

6. The light source of claim 5 wherein the pin is mounted within the housing.

7. The light source of claim 4 further comprising a pin disposed between the diaphragm and the valve such that movement of the diaphragm between the first position and the second position actuates the valve.

8. The light source of claim 1 further comprising a chamber within the housing at least partially enclosed by the diaphragm such that the diaphragm controls the flow of fuel into the chamber from a fuel source.

9. The light source of claim 1 further comprising a biasing element urging the diaphragm from the closed position to the open position.

10. The light source of claim 9 wherein the biasing element is a spring.

11. The light source of claim 1 further comprising a venturi disposed between the diaphragm and mantle.

12. The light source of claim 1 further comprising a switch that is coupled to the diaphragm and is adjustable between three selected positions such the valve is open in a first switch position, closed in a second switch position, and free to reciprocate between open and closed in a third switch position.

13. A pulsating light source comprising:

a housing supporting a mantle to which a fuel is continuously directed for combustion;

a flexible diaphragm that partially encloses a chamber within the housing, the diaphragm being bistable and movable between a first stable position and a second stable position;

a movable stem coupled to the diaphragm and having a conduit there through which continuously delivers fuel from the chamber to the mantle; and a regulator valve actuated by movement of the diaphragm to control fluid communication between a fuel source and the chamber whose column is adjusted by the diaphragm movement such that when the diaphragm is in the first stable position the regulator valve is open and when the diaphragm is in the second stable position the regulator valve is closed.

14. The light source of claim 13 wherein the diaphragm has reduced stress in the first and second position relative to the diaphragm stress between the first and second position.

15. The light source of claim 14 wherein the first and second positions of the diaphragm have reduced energy relative to the diaphragm energy in any other position.

16. The light source of claim 13 wherein the diaphragm has an intrinsic compressive stress.

17. The light source of claim 13 further comprising a chamber at least partially enclosed by the diaphragm, the chamber being in fluid communication with a venturi through the conduit and in fluid communication with the source through the regulator valve.

18. The light source of claim 13 further comprising a check valve disposed between the fuel source and the regulator valve to control the flow of fuel between the source and the regulator valve.

19. The light source of claim 18 wherein the check valve biasing element is a coil spring.

20. The light source of claim 13 wherein the regulator valve comprises a regulator valve housing having a fuel entrance for receiving gaseous fuel into the regulator valve housing and an aperture for delivery of fuel from the regulator valve housing to the mantle, a valve seat at the aperture compatible with the regulator valve for sealing the fuel source from the mantle, a check valve provides fluid communication between the source and the regulator valve when the pressure drop across the check valve is in excess of a preselected minimum and such that the check valve is directed onto a check valve seat by a check valve biasing element to seal the reservoir from the regulator valve when the pressure drop across the check valve is below the preselected minimum.

21. The light source of claim 20 further comprising a regulator valve biasing element.

22. The light source of claim 20 wherein the regulator valve biasing element is a coil spring.

23. A method of generating a pulsating light comprising:

providing a housing supporting a lamp for igniting a fuel, a flexible diaphragm within the housing, a stem having a conduit disposed in the housing for continuously flowing gaseous fuel therethrough, and a chamber having a valve at an entrance aperture and that is partially enclosed by the diaphragm;

flowing gaseous fuel from a fuel source through the chamber and the conduit to the lamp;

continuing the flow of fuel from the source into the chamber to increase the pressure of gaseous fuel in the chamber while the diaphragm is in a first position;

displacing the diaphragm to a second position in response to the pressure increase to actuate closure of the valve and prevent the flow of fuel from the source to the chamber while continuing the flow of fuel from the chamber to the lamp;

reducing the flow of gas through the conduit as pressure within the chamber diminishes without extinguishing the lamp; and directing the diaphragm back to the first position re-establishing fluid communication of fuel from the source with the chamber.

24. The method of claim 23 wherein the stem is coupled to the diaphragm.

25. The method of claim 23 wherein the diaphragm is bistable such that the diaphragm has reduced stress in the first and second positions relative to other diaphragm positions.

26. The method of claim 23 further comprising the step of providing a regulator valve disposed between the source and the chamber for sealing the reservoir from the diaphragm when the diaphragm is in the second position and for re-establishing fluid communication between the source and the diaphragm when the diaphragm is in the first position.

27. The method of claim 23 further comprising the steps of providing a venturi adjacent the stem and flowing fuel through the venturi to the lamp.

28. The method of claim 23 further comprising the step of providing a biasing element for urging the diaphragm from the second position to the first position.

29. The method of claim 28 wherein the biasing element is a spring.

30. A method of generating a pulsating gas flow comprising:

directing gas through a regulator valve into a diaphragm chamber, the regulator valve reciprocating between open and closed positions upon actuation by a flexible diaphragm that reciprocates between first and second positions having reduced diaphragm stress relative to the diaphragm stress between the first and second positions;

increasing the pressure of the gas within the diaphragm chamber such that the diaphragm moves from a first position to a second position to close the regulator valve; and removing gas from the diaphragm chamber such that the pressure within the diaphragm chamber is reduced to a threshold level causing the diaphragm to move its first position and reopen the regulator valve.

31. The method of claim 30 wherein the diaphragm is coupled to the regulator valve.

32. The method of claim 30 wherein there is a continuous flow of gas from the chamber throughout the reciprocating motion of the diaphragm.

33. A pulsating gas fuel light source comprising:

a housing supporting a lamp to which a fuel is continuously delivered for combustion;

a chamber within the housing to receive fuel from a source;

a flexible diaphragm secured within the housing and partially enclosing the chamber, the diaphragm being formed to reciprocate between a first position and a second position in response to variations in pressure of a gas within the housing such that the diaphragm has reduced stress in the first and second positions relative to the diaphragm stress between the first and second positions; and a regulator valve to control the flow of fuel between the source and the chamber that is opened by movement of the diaphragm into the first position resulting in the delivery of fuel at an increased rate to the lamp and such that when the diaphragm is in the second position the valve closes resulting in the reduction of the rate of fuel delivery to the lamp; and a coupling member secured to the valve such that the diaphragm movement actuates the member and the valve.

34. The light source of claim 33 wherein movement of the diaphragm actuates movement of the coupling member and wherein the member is separable from the diaphragm.

35. The light source of claim 33 wherein the member is coupled to the diaphragm.

36. The light source of claim 33 further comprising a switch that is coupled to the diaphragm and is adjustable between three selected positions such the valve is open in a first switch position, closed in a second switch position, and free to reciprocate between open and closed in a third switch position.

* * * * *